US005079874A

United States Patent [19]

Lüber

[11] Patent Number: 5,079,874

[45] Date of Patent: Jan. 14, 1992

[54] PROCESS FOR CONTROLLING AN AUTOMATIC MACHINE FOR CLEANING CASTINGS

[76] Inventor: Werner Lüber, Bahnhofstr. 23/32, 9602 Bazenheid, Switzerland

[21] Appl. No.: 491,076

[22] Filed: Mar. 9, 1990

[30] Foreign Application Priority Data

Mar. 29, 1989 [CH] Switzerland ..... 01129/89

[51] Int. Cl.[5] ..... B24B 49/00

[52] U.S. Cl. ..... 51/165.77; 51/165.87; 51/165.88; 408/10; 409/193; 83/522.16; 83/72

[58] Field of Search ..... 51/165.77, 165.92, 267, 51/165.87, 165.88, 206 R; 364/474.06; 83/522.16, 522.17, 72; 408/10, 11, 12; 409/193, 194, 195

[56] References Cited

U.S. PATENT DOCUMENTS 3,952,458 4/1976 Tomita et al. ..... 51/165.77

*Primary Examiner*—M. Rachuba
*Attorney, Agent, or Firm*—Spencer & Frank

[57] ABSTRACT

An automatic grinding machine for cleaning castings, including a machine stand, supporting mutually adjustable clamping or holding devices for processing a casting, and further including a tool holder, on which a grinding and/or cutting-off disk is adjustable with respect to the casting via a sliding device supported on a machine support, permits non-contact, precise generation of a control signal. The clamping devices are electrically insulated from the machine stand, and the grinding and/or cutting-off disk is electrically insulated from the tool holder. The grinding and/or cutting-disk is electrically conductive. The grinding and/or cutting-off disk and the clamping devices, including the casting held therebetween, are series-connected to a regulable high-tension generator and an ignition current evaluating switching unit, which supplies the control signal.

7 Claims, 1 Drawing Sheet

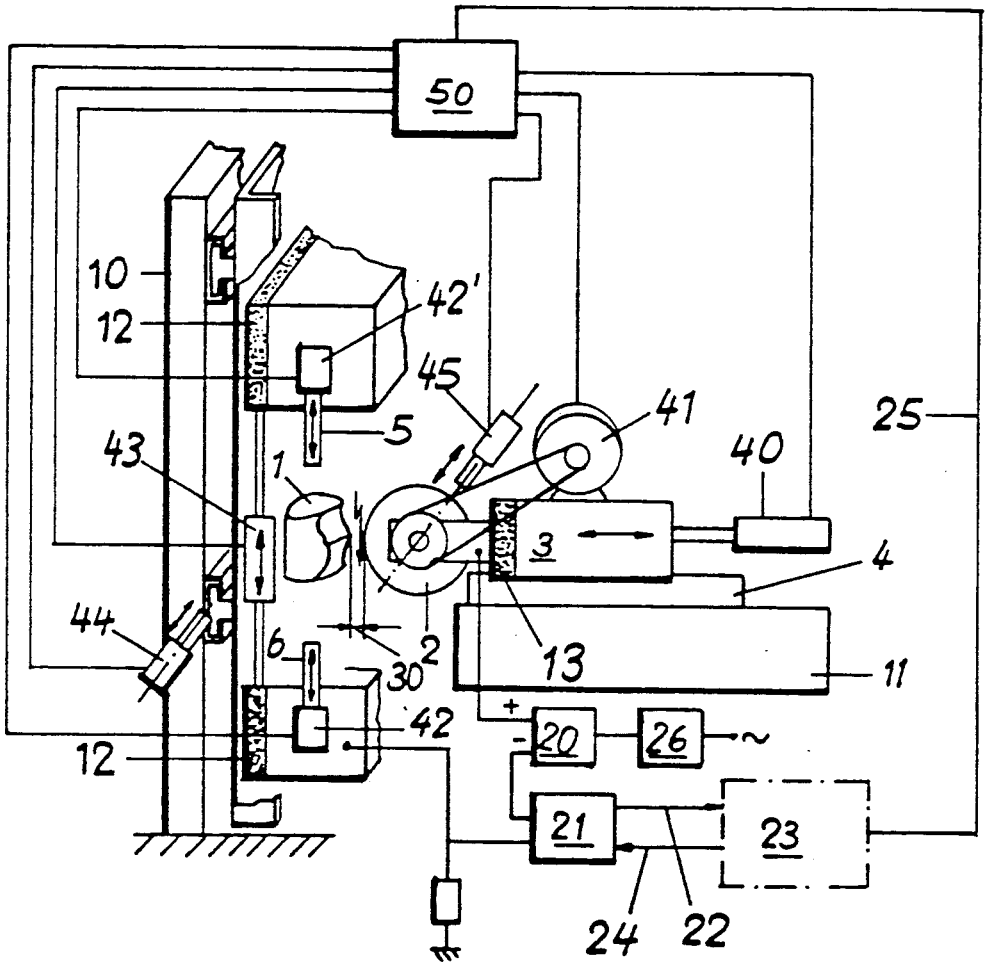
50
10
12
42'
45
41
25
5
43
1
40
3
4
44
6
2
13
11
30
42
12
20
26
21
23
24
22

PROCESS FOR CONTROLLING AN AUTOMATIC MACHINE FOR CLEANING CASTINGS

BACKGROUND OF THE INVENTION

The present invention relates to a process and apparatus for controlling an automatic machine for cleaning castings, in particular grinding machines for cleaning castings, by which a grinding or cutting-off disk engages on a clamped casting and then at least the operating advance of the grinding or cutting-off disk is program controlled by means of control data dependent on the workpiece.

In known processes of the aforementioned kind, noise or vibration resulting from the grinding tool touching the workpiece is employed for switching over from preparation speed to operating speed or as start signal for a program control, appropriate electric control signals being attained via vibration meters and frequency converters.

The attainment of the signal always requires, thereby, a contact between grinding disk and casting, which is contradictory to a precise control by a pre-signal. In addition, frequency-dependent measurements of the contact between grinding disk and casting are completely unsuited for aluminium castings.

Pressure force arising due to the functionally-dependent shortening of the circumferential length, which, from a critical height of lift, causes a bending-in on the edge of the cell in relation to the seam areas, and which decreases the longevity of the cell considerably. In order to counteract this, fluid cells according to the second-mentioned method of construction have been designed, whereby the tangential pressure force arising in the edge parts is at least partially eliminated by tangential traction on the convex circumferential parts. However, also this has not lead to suitable results: wherefore the effectiveness of such fluid cells based on compressed air radial motors has never succeeded in being generally adopted in spite of the many excellent qualities thereof.

SUMMARY OF THE INVENTION

It is therefore an object of the present invention to develop a process of the aforementioned kind by which a pre-signal, necessary and suitable for a precise introduction of the programmed machining operation, is capable of being generated, independent of the material of the casting.

According to the invention, this is achieved due to the fact that the distance of proximity between grinding or cutting-off disk and casting is employed as measure of comparison for releasing an electric control signal for inducing the program control.

As a result of these steps, a control signal can be generated which is effective prior to contact between grinding or cutting-off disk and casting, and thus introduce a precise program-controlled machining of the casting, independent and unaffected by vibrations. In this connection, it is, moreover, insignificant what material the workpiece consists of.

The distance of proximity between grinding or cutting-off disk and casting may be monitored by a light barrier or by a laser beam in order to generate an electric control signal at a pre-specified proximity, which is not always sufficiently precise owing to external influences such as a turbidity of the optics, machine vibration and the like. Advantageous in this connection, however, would be the possibility of reequipping existing machines without excessive expenditure.

More advantageous is, on the other hand, that a regulable high-tension electrical potential is built up between the grinding or cutting-off disk and the casting, the magnitude of the tension and the size of the air gap, forming a sparkover gap between the grinding or cutting-off disk and the casting, being a measure for the ignition tension, which produces the electric control signal.

Although this requires a grinding or cutting-off disk that is of electrically-conductive construction as well as tool and workpiece holders that are insulated from the machine frame, highly precise pre-selectable and pre-adjustable ignition moments at practically any selectable width of air gap between the disk and casting drawn near to each other are achieved. At a suitable voltage potential, for example, between 1,000 and 20,000 volt, proximities of, for instance, 1 to 8 mm air gap width can be specified, at which proximity the control signal is released by arc ignition.

A further improvement of the quality of the machining of the casting by means of a grinding or cutting-off disk requires that the unstable behavior of all parts of the machine for cleaning castings that are movably connected are eliminated. This can be achieved in that the control signal induces a program-controlled, lineal operating advance of the grinding or cutting-off disk and simultaneously brings all other adjusting devices of the grinding machine for cleaning castings into a state of rigid coordination.

Due to the fact that now only the grinding or cutting-off disk receives a lineal advance at the machining operation and all other adjusting devices are brought to a state of rigid coordination, eventual vibrations transferred to the adjusting devices can no longer have a negative effect.

The present invention relates, moreover, to an automatic grinding machine for cleaning castings, comprising a machine stand, supporting clamping or holding devices, which are mutually adjustable towards each other, for processing a casting, and comprising a tool holder, on which a grinding and/or cutting-off disk is adjustable with respect to the casting via sliding means supported on a machine support.

According to the invention, the grinding machine for cleaning castings distinguishes itself in that the clamping devices are electrically insulated on insulating means from the machine stand, and the grinding and/or cutting-off disk is electrically insulated on insulating means from the tool holder; the grinding and/or cutting-off disk is electrically-conductive; and the grinding and/or cutting-off disk and the clamping devices, including the casting held therebetween, are series-connected to a regulable high-tension generator and an ignition current evaluating switching unit which supplies the control signal.

In this connection, the adjusting devices for the slide means or clamping devices are hydraulic servomotors or hydraulic cylinders which can be centrally controlled and immobilized.

Further, the present invention relates to a grinding or cutting-off disk for carrying out the process which distinguishes itself by an electrically-conductive construction over the entire extent of the disk.

BRIEF DESCRIPTION OF THE DRAWING

An exemplary embodiment of the subject of the invention will be more closely explained in the following by reference to the drawing, which shows in diagrammatic representation an automatic grinding machine for cleaning castings for carrying out the process according to the invention.

DETAILED DESCRIPTION OF THE PREFERRED EMBODIMENTS

The automatic grinding machine for cleaning castings for processing a cast workpiece 1 comprises a machine stand 10, on which clamping devices 5 and 6 for the casting 1 are supported so that they are capable of moving vertically, horizontally and towards each other. The adjusting devices are in this case preferably hydraulic cylinders 42, 42', 43 and 44, which are in operative connection to a controllable hydraulic control system 50 via appropriate supply pipes.

Further, opposite the area of the cast workpiece, is a tool holder 3, on which a grinding and/or cutting-off disk 2 is adjustable with respect to the casting 1 via sliding means 4, supported on a machine support 11. Hereby, a motor or, as is shown, a hydraulic cylinder 40, can bring about the adjusting advance. Furthermore, the tool holder 3 can, in addition, be disposed on the slide means 4 for a transverse advance, which then, as indicated, is effected by another hydraulic cylinder 45.

In place of the hydraulic cylinders, hydraulic or electric servomotors are also possible.

The adjusting devices on the machine support 11 are also in operative connection with said hydraulic control 50. This operative connection may also be provided for the drive motor 41 of the grinding or cutting-off disk 2.

In order to attain a control signal as a function of the distance of proximity between the grinding or cutting-off disk 2 and the casting 1, which control signal, for example, interrupts the fast advance for engaging the tool on the workpiece, and which control signal, moreover, possibly simultaneously, brings all hydraulic adjusting devices for setting-up and pre-adjusting to a state of rigid coordination, and which control signal, for instance, introduces program control dependent on the casting, the grinding and/or cutting-off disk 2 and the clamping devices 5 and 6, including the casting 1 held therebetween, are series-connected to a regulable high-tension generator 20 and an ignition current evaluating switching unit 21, which supplies control signal 22. Said circuitry comprises, in addition to this, a regulating stage 26, connected to the high-tension generator 20. The output signal 22 arrives then at a CNC-control arrangement 23 or the like, which, for its part, controls the hydraulic controls 50 by means of control signal 25 and, in addition, is back coupled by means of clear signal 24. The output voltage on the high-tension generator 20 may, thereby, amount to 1,000 to 20,000 volts, whereas the limited ignition current is not to exceed 0.1 mA. The level of the output signal 22 of the ignition current evaluating switching unit 21 is about 24 volts.

Such switchings units 21 are known per se so that further explanations are redundant. This also applies to the numerical controls relevant here, such as the CNC-control 23.

It is essential that the clamping devices 5,6 are electrically insulated on insulating means 12 from the machine stand 10, and the grinding and/or cutting-off disk 2 is electrically insulated on insulating means 13 from the tool holder 3.

Moreover, the grinding or cutting-off disk has to have an electrically-conductive construction over the entire extent thereof, for instance, by the inclusion of graphite in the grinding or abrasive body or by the inclusion or application of copper gauze or mesh.

Such a grinding or cutting-off disk is the object of a patent application filed simultaneously by the same applicant.

Thus, a regulable high-tension potential is built up between the grinding or cutting-off disk 2 and the casting 1, the magnitude of the tension and the size of the air gap 30, forming a sparkover gap, between disk and casting being a measure for the ignition tension, which produces the electric control signal 22.

While there are shown and described preferred embodiments of the invention, it is to be distinctly understood that the invention is not limited thereto but may be embodied and practised within the scope of the following claims. ACCORDINGLY,

What I claim is:

1. A process for controlling an automatic machine for cleaning castings, in particular grinding machines for cleaning castings, wherein:

a grinding or cutting-off disk advances towards a clamped casting; and then at least the advance of the grinding or cutting-off disk is program controlled by means of control data dependent on the workpiece, wherein the distance of proximity between grinding or cutting-off disk and casting is employed as measure of comparison for producing an electric control signal for inducing the program control, and wherein a regulable high-tension potential is built up between the grinding or cutting-off disk and the casting.

2. The process as defined in claim 1, wherein the magnitude of the potential and the size of the air gap, forming a sparkover gap, between the grinding or cutting-off disk and the casting is measure of ignition tension which produces the electric control signal.

3. The process as defined in claim 1, wherein the electric control signal induces a program-controlled, lineal operating advance of the grinding or cutting-off disk and simultaneous coordination of all other adjusting devices of the grinding machine for cleaning castings.

4. An automatic grinding machine for cleaning castings, comprising:

a machine stand, supporting clamping or holding devices, which are mutually adjustable towards each other, for processing a casting; and a tool holder, on which an electrically conductive grinding and/or cutting-off disk is adjustable with respect to a casting via sliding means which is supported on a machine support, wherein the clamping or holding devices are electrically insulated on insulating means from the machine stand, the grinding and/or cutting-off disk is electrically insulated on insulating means from the tool holder, and the grinding and/or cutting-off disk and the clamping or holding devices, including the casting held therebetween, are series-connected to a regulable high-tension electrical generator and an ignition current evaluating switching unit, which produces a control signal for automatic control of the grinding machine.

5. The grinding machine for cleaning castings as defined in claim 4, wherein adjusting devices for the slide means or the clamping or holding devices are hydraulic servomotors or hydraulic cylinders which can be centrally controlled.

6. An automatic grinding machine for cleaning castings, comprising:

a machine stand, supporting clamping or holding devices, which are adjustable towards each other, for processing a casting, a tool holder, on which a grinding and/or cutting-off disk is adjustable to advance with respect to the casting via sliding means, and at least the advance of the grinding and/or cutting-off disk is program controlled by means of control data dependent on the workpiece, wherein:

the clamping or holding devices are electrically insulated on insulating means from the machine stand, and the grinding and/or cutting-off disk is electrically insulated on insulating means from the tool holder;

the grinding and/or cutting-off disk is electrically-conductive; and the grinding and/or cutting-off disk and the clamping or holding devices, and the casting held therebetween, are series-connected to a regulable high-tension generator and an ignition current evaluating switching unit, which supplies a control signal;

a regulable high-tension potential is built up across an air gap between the grinding and/or cutting-off disk and the casting, the magnitude of the potential and the size of the air gap, forming a sparkover gap, between the grinding and/or cutting-off disk and the casting being a measure for the ignition tension, which brings about the electric control signal;

the control signal causing a program-controlled, lineal operating advance of the grinding and/or cutting-off disk and simultaneously brings all other adjusting devices of the grinding machine for cleaning castings to a state of rigid junction.

7. The grinding machine for cleaning castings as defined in claim 6, wherein:

adjusting devices for the slide means or clamping devices are hydraulic servomotors or hydraulic cylinders which can be centrally controlled and immobilized.

* * * * *